United States Patent [19]

Cantrell

[11] 4,107,932

[45] Aug. 22, 1978

[54] PORTABLE DOCK

[76] Inventor: Seals R. Cantrell, P.O. Box 679, Cedartown, Ga. 30125

[21] Appl. No.: 827,162

[22] Filed: Aug. 24, 1977

[51] Int. Cl.[2] ..... E02B 17/00

[52] U.S. Cl. ..... 61/48; 14/69.5

[58] Field of Search ..... 61/48, 49, 63; 14/71.1, 14/69.5, 36, 37, 42, 1

[56] References Cited

U.S. PATENT DOCUMENTS

| | | | |
|---|---|---|---|
| 1,232,437 | 7/1917 | Simpson | 14/69.5 |
| 1,329,924 | 2/1920 | Paul | 14/71.1 |
| 3,043,109 | 7/1962 | Erickson | 61/48 |
| 3,050,947 | 8/1962 | Burton | 61/48 |
| 3,088,287 | 5/1963 | Berry | 61/48 |
| 3,274,629 | 9/1966 | Gearon et al. | 14/71.1 |
| 3,492,825 | 2/1970 | Pearson | 61/48 |
| 3,747,354 | 7/1973 | Macomber | 14/69.5 X |
| 3,884,043 | 5/1975 | Timmermans | 14/71.1 X |
| 3,953,980 | 5/1976 | Bennett | 61/48 |

FOREIGN PATENT DOCUMENTS

| | | | |
|---|---|---|---|
| 34,793 | 5/1968 | German Democratic Rep. | 61/48 |
| 976,272 | 11/1964 | United Kingdom | 61/48 |

*Primary Examiner*—Dennis L. Taylor

[57] ABSTRACT

This portable dock consists primarily of a channelled body portion, for being anchored on the bank of a body of water, the body portion being hinged to a ladder, which is elevatable, and provided with anchor pin means for embedding into the bed beneath the water level. The dock includes removable hand rails.

1 Claim, 7 Drawing Figures

PORTABLE DOCK

This invention relates to docks, and more particularly, to a portable dock.

It is, therefore, the principal object of this invention to provide a portable dock, which will be fully folded for storage, and will be fully safe in use.

Another object of this invention is to provide a portable dock, which will have the walk portion consisting of a plurality of non-slip slats, and the rungs of the ladder portion will be non-slip.

A further object of this invention is to provide a portable dock, of the type described, which will have removable hand rails on both the slatted body and the ladder.

Other objects of the invention are to provide a portable dock, which is simple in design, inexpensive to manufacture, rugged in construction, easy to use and efficient in use.

These, and other objects, will be readily evident, upon a study of the following specification, and the accompanying drawing, wherein.

Figures 1, 2, 3, 4, 5, 6, 7:
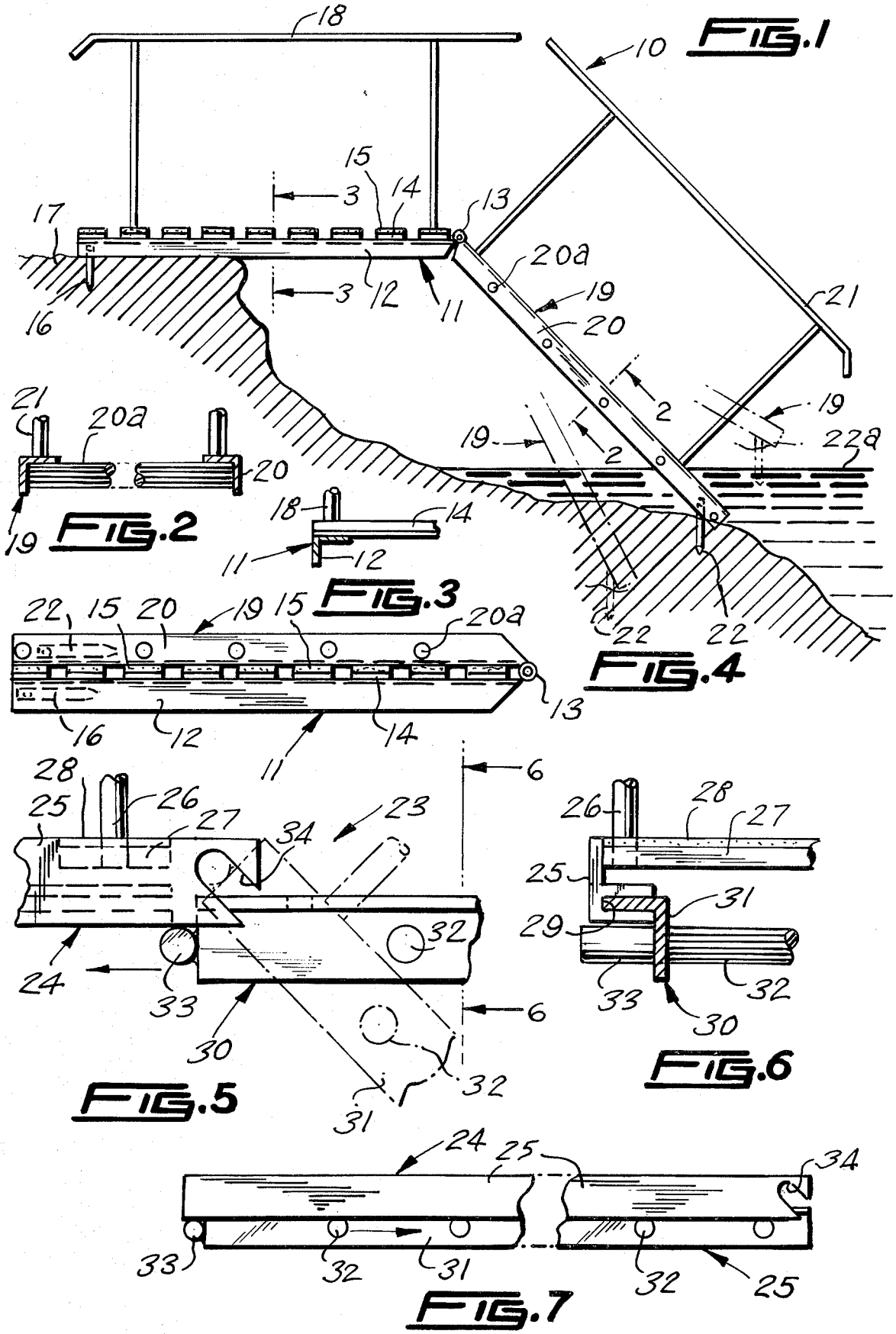
FIG. 1 is a side view of the present invention shown in use, and shows in phantom lines, different angular positions of the ladder portion of the dock.
FIG. 2 is a cross-sectional view, taken along the line 2—2 of FIG. 1.
FIG. 3 is a cross-sectional view, taken along the line 3—3 of FIG. 1.
FIG. 4 is a horizontal side view of the structure of FIG. 1, shown in elevation and folded for storage, the rails being shown removed therefrom.
FIG. 5 is an enlarged fragmentary side view of a modified form of the invention, shown in elevation, the device being of two pieces, which are telescopingly received within each other, the right section being provided with pin means, for being received in notch means of the left section, when in use.
FIG. 6 is a cross-sectional view, taken along the line 6—6 of FIG. 5.
FIG. 7 is a horizontal side view of FIG. 5, shown in elevation and telescoped for storage, the rails being shown removed therefrom.

According to this invention, a portable dock 10 is shown to include a platform body 11, consisting of a pair of parallel spaced apart channels 12, upon which is fixedly secured hinge 13 means, at one end, for a purpose which hereinafter will be described. A plurality of equally spaced apart slats 14 are fixedly secured to channels 12, and fixedly secured, in a suitable manner, to slats 14, is a resilient cover, for preventing a person from slipping. A pair of pinnable anchor pins 16, on one end of body 11, provide a means for anchoring the platform body 11 to the bank 17. A pair of removable hand rails 18 are secured within a pair of the slats 14. A ladder 19 is secured to hinge 13, so as to be foldable with body 11, when it is placed in storage. Ladder 19 is provided with a pair of channels 20, in which are fixedly secured serrated rungs **20*a*, for a person to ascend or descend the platform body 11**.

Ladder 19 is also provided with removable hand rails 21, and at the ends opposite the hinge 13 means, pivotable anchor pins 22 are provided, for insertion into the bed beneath the water level **22*a***.

Referring now to FIGS. 5, 6 and 7, a modified form of portable dock 23 is shown to consist of a platform body 24, constructed of a pair of parallel, spaced-apart channels 25. Handrails 26 are removably mounted within plates 27, which form slat means for body 24. The plate slats 27 are provided with non-slip covers 28, and slats 29, of channel numbers 25, telescoping receive ladder 30. Ladder 30 consists of a pair of parallel, spaced-apart channels 31, that are telescopingly slidable within slats 29. A plurality of serrated rungs 32 are fixedly secured to channels 31, and the extensions 33 provide a means for being removably received within the slots 34, so as to enable ladder 30 to support the platform body 24.

While various changes may be made in the detail construction, it is understood that such changes will be within the spirit and scope of the present invention, as is defined by the appended claims.

What I now claim is:

1. A portable dock, comprising, in combination, a platform body and a ladder, hinge means between one end of said platform body and one end of said ladder, an opposite end of said platform body and an opposite end of said ladder, each having a plurality of anchor pins, said platform body being comprised of a pair of parallel spaced-apart channels, a plurality of parallel, spaced-apart slats supported on said channels, and an upwardly extending hand rail along each side of said platform body; said ladder being comprised of a pair of parallel spaced-apart channels, supporting a plurality of transverse extending rungs therebetween, a removable hand rail along each side of said ladder, and said hinge means comprising a transverse extending extension bar across the first said end of said ladder, said extension being receivable in a slot in an end of each said channel of said platform body, said extension being removable from said slots, and said ladder channels being slidable within said channels of said platform body.

* * * * *